US007267041B2

(12) United States Patent
Kuhn

(10) Patent No.: US 7,267,041 B2
(45) Date of Patent: Sep. 11, 2007

(54) RECIPROCATING PISTON COMPRESSOR

(75) Inventor: Peter Kuhn, Weinheim (DE)

(73) Assignee: Obrist Engineering GmbH, Lustenau (AT)

( * ) Notice: Subject to any disclaimer, the term of this patent is extended or adjusted under 35 U.S.C. 154(b) by 262 days.

(21) Appl. No.: 11/152,603

(22) Filed: Jun. 14, 2005

(65) Prior Publication Data

US 2005/0276699 A1 Dec. 15, 2005

(30) Foreign Application Priority Data

Jun. 14, 2004 (DE) ..... 10 2004 028 747

(51) Int. Cl.
*F01B 13/04* (2006.01)

(52) U.S. Cl. ..... 92/12.2; 91/505

(58) Field of Classification Search ..... 92/12.2, 92/71; 91/499, 505; 417/222.1, 222.2; 74/39
See application file for complete search history.

(56) References Cited

U.S. PATENT DOCUMENTS 3,211,106 A * 10/1965 Kaup et al. ..... 92/12.2
3,861,829 A * 1/1975 Roberts et al. ..... 417/222.2
4,815,358 A * 3/1989 Smith ..... 92/12.2
4,836,090 A * 6/1989 Smith ..... 92/12.2

* cited by examiner

*Primary Examiner*—Michael Leslie
(74) *Attorney, Agent, or Firm*—Ladas and Parry LLP

(57) ABSTRACT

The reciprocating piston compressor has several parallel cylinder-piston units (7, 8) in a common compressor casing (3) and whose pistons (8) are moved by a rotary wobble plate (11) by means of a coupling bracket (9) surrounding sliding pads (12). For modifying the wobble plate inclination as a result of a regulated pressure in the compressor casing it is swivellably held by two articulated brackets (23, 24) on a recess (29) of the drive shaft (4). Together with the recess (29) and the spacing between the bilateral connection points to the wobble plate (11), said articulated brackets (23, 24) form a four-bar linkage, whose geometry ensures a functionally correct swivelling movement. The four joints (25 to 28) of the four-bar linkage are formed by uniaxial swivel joints, whose low frictional resistance leads to an improved control behaviour on controlling the delivery rate of the compressor.

11 Claims, 4 Drawing Sheets

RECIPROCATING PISTON COMPRESSOR

BACKGROUND OF THE INVENTION

The invention relates to a reciprocating piston compressor with several cylinder-piston units located in a common compressor casing and which are parallel to one another and to a drive shaft, which is embraced by a wobble plate swivellably coupled thereto and to which the pistons are connected by means of an articulated sliding coupling.

A compressor of this type is known from DE 4139186. In the latter the wobble plate is swivellably guided on a spherical body supported by the drive shaft and is connected in radially spaced manner therefrom by means of a dog to said drive shaft. In order to be able to perform the swivelling movement necessary for changing the piston stroke length, the connection to the dog takes place by means of a connecting bolt guided in an elongated hole of said dog.

As the wobble plate inclination is to be set on the basis of the regulated pressure difference acting on the pistons, it is particularly important for the response sensitivity of the control that the swivelling movement is implemented with a limited frictional resistance. The problem of the invention is to provide a reciprocating piston compressor having an improved control behaviour as a result of the low frictional resistances on implementing the swivelling movement and which in the case of compact dimensions has a relatively large maximum stroke length of its pistons so as to permit a high delivery rate and which is relatively simple and therefore inexpensive to manufacture.

DESCRIPTION OF THE INVENTION

In the case of a compressor of the aforementioned type, the invention solves this problem in that the wobble plate is coupled to the drive shaft by means of a single or double four-bar linkage having a swivellable articulated bracket and in each case one of the uniaxially implemented four joints are bilaterally provided on the wobble plate, whilst two other joints are provided in axially spaced manner on the drive shaft.

BRIEF DESCRIPTION OF THE DRAWINGS

Advantageous embodiments of the invention form the subject matter of the dependent claims and can be gathered from the following description relative to the attached drawings, wherein show:

DETAILED DESCRIPTION OF AN EMBODIMENT

Figure 1:
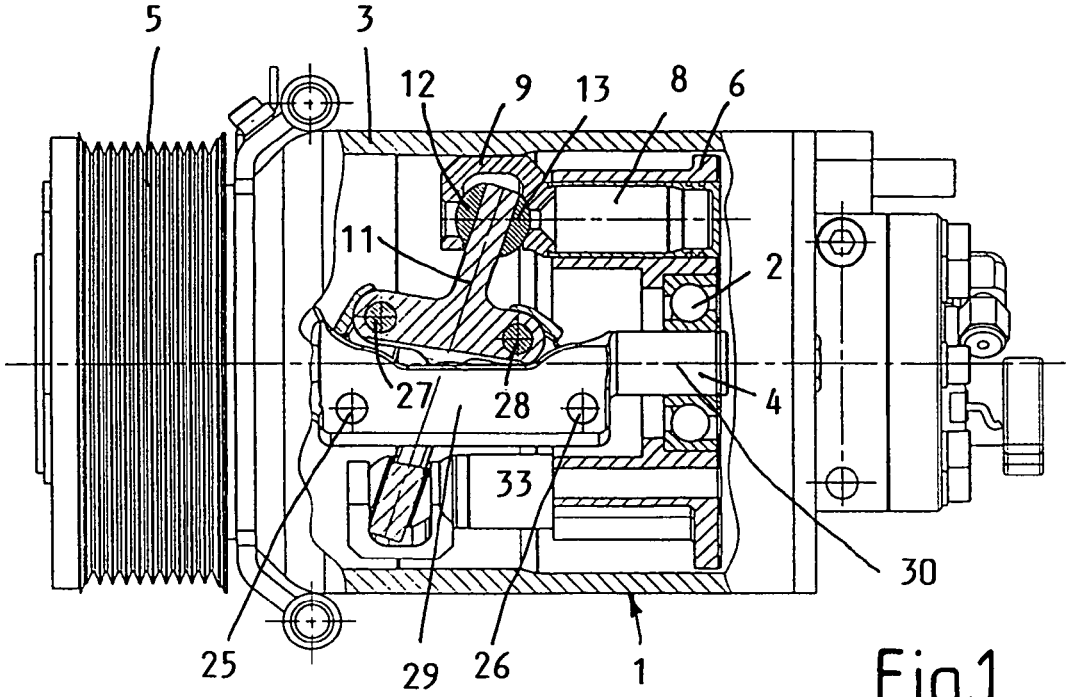
FIG. 1 A partly axially sectioned side view of a compressor according to the invention with a wobble plate swivelled in inclined manner with respect to the drive shaft.
Figure 2:
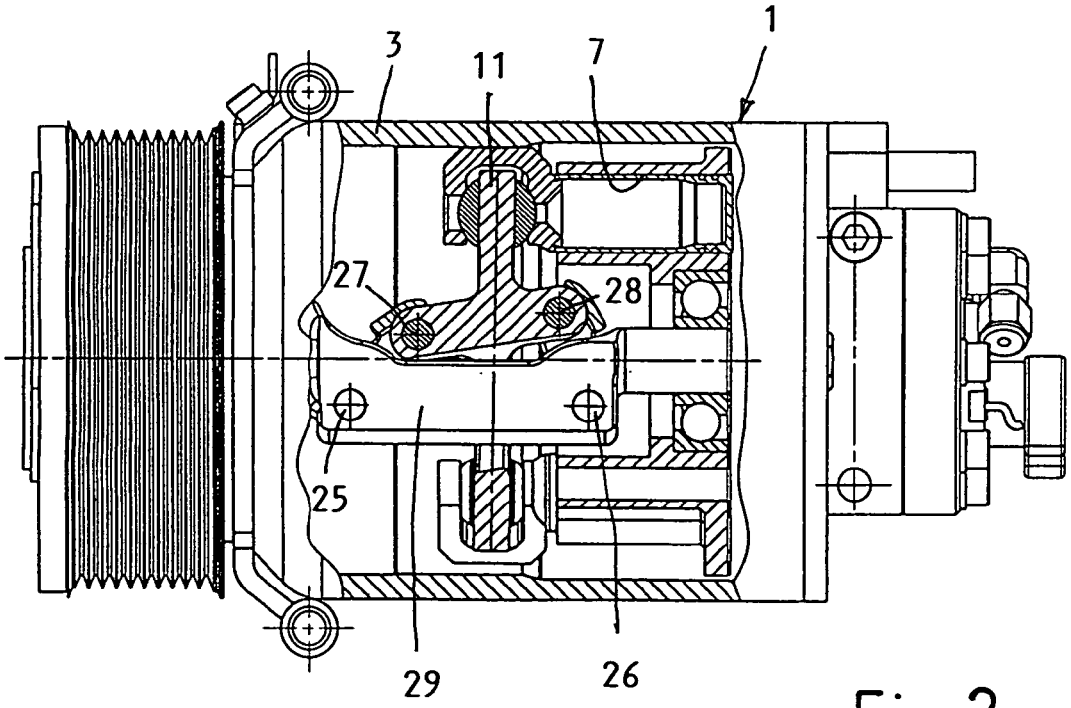
FIG. 2 A representation corresponding to FIG. 1 with the wobble plate in the neutral position.
Figure 3:
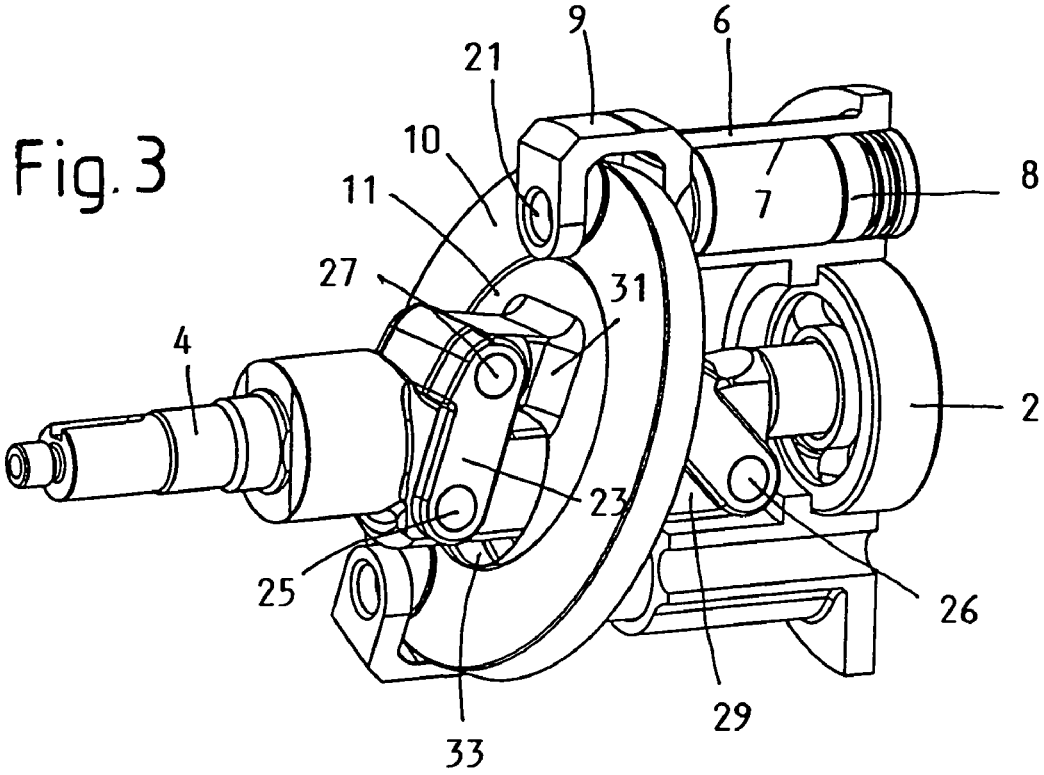
FIG. 3 A perspective view of the mechanics of the compressor according to FIG. 1 on omitting the compressor casing.
Figure 4:
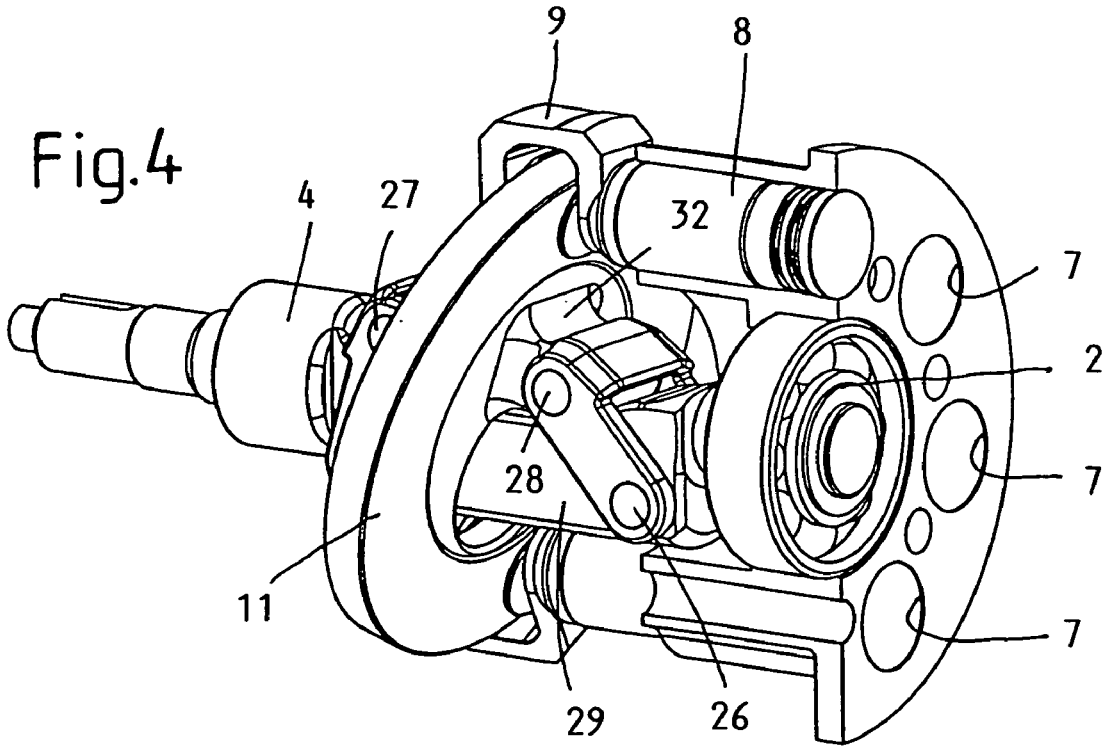
FIG. 4 A perspective view of the arrangement according to FIG. 3 under a different viewing angle.
Figure 5:
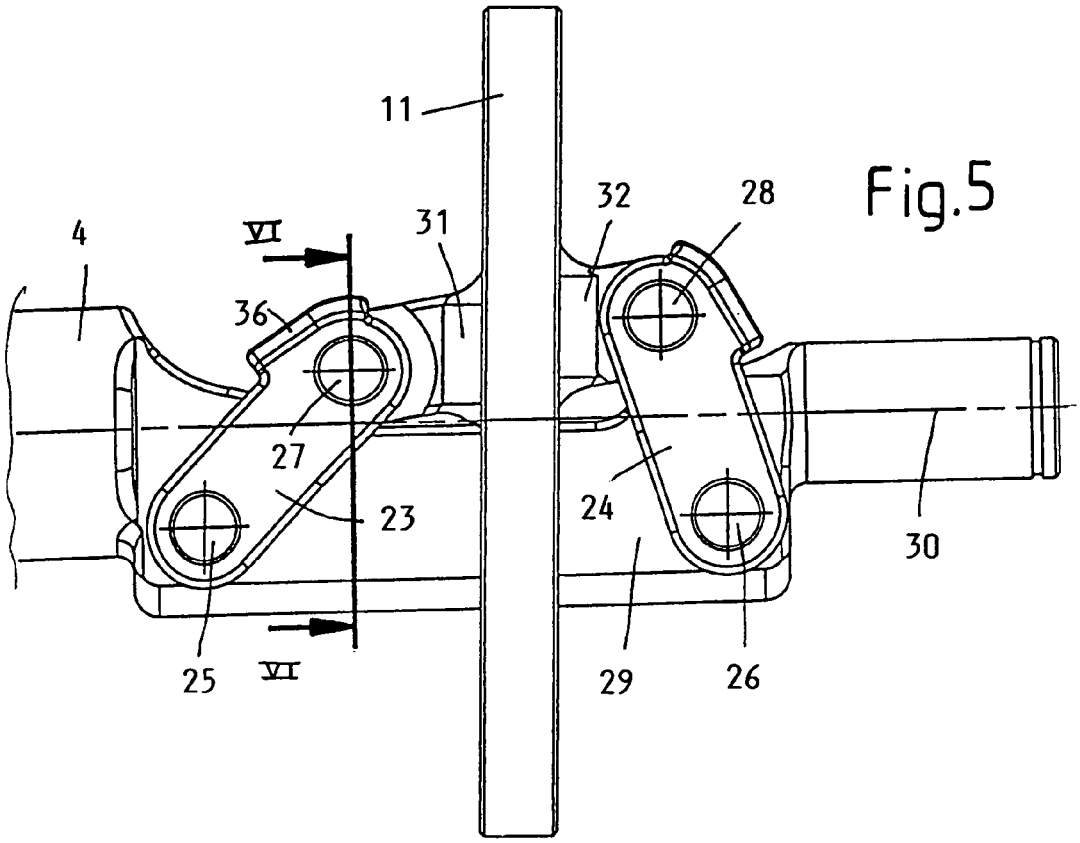
FIG. 5 A lateral partial view of the compressor gear in the vicinity of its four-bar linkage.

The compressor 1 e.g. provided for the air conditioning system of a vehicle has a drive shaft 4 centrally mounted by antifriction bearings 2 in its casing 3 and which carries at its outer end a belt pulley 5 in order to produce a drive connection with the vehicle engine. The casing 3 surrounds an inner casing part 6, in which in circumferentially distributed manner are e.g. provided seven cylinder bores 7 and in which is held the antifriction bearings 2.

The pistons 8 guided in the cylinder bores are provided at their drive-side end with an articulated sliding coupling with a coupling bracket 9 in which engages the outer circumferential area 10 of the wobble plate 11 and in which it is in drive connection with the pistons 8 by means of spherical segmental sliding pads 12, 13. The bilateral spherical surfaces 14, 15 necessary for the rotary mounting of the sliding pads 12, 13 in the coupling bracket 9 are worked into separate, additional intermediate members in accordance with the aforementioned prior art and which are inserted in the coupling brackets.

Figure 9:
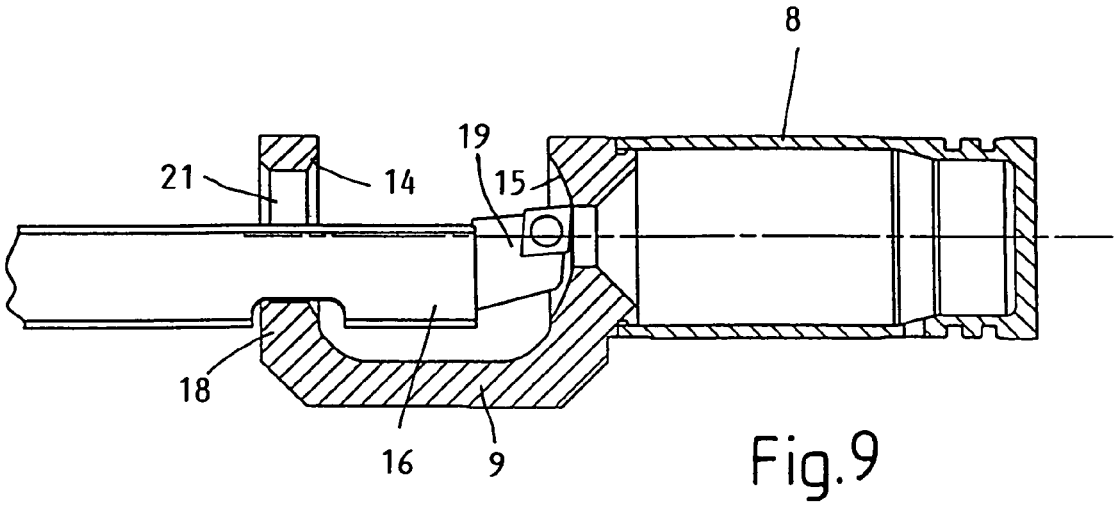
FIG. 9 A larger scale cross-sectional view of a piston, showing the tool guidance during the machining of a spherical action plane.
Figure 10:
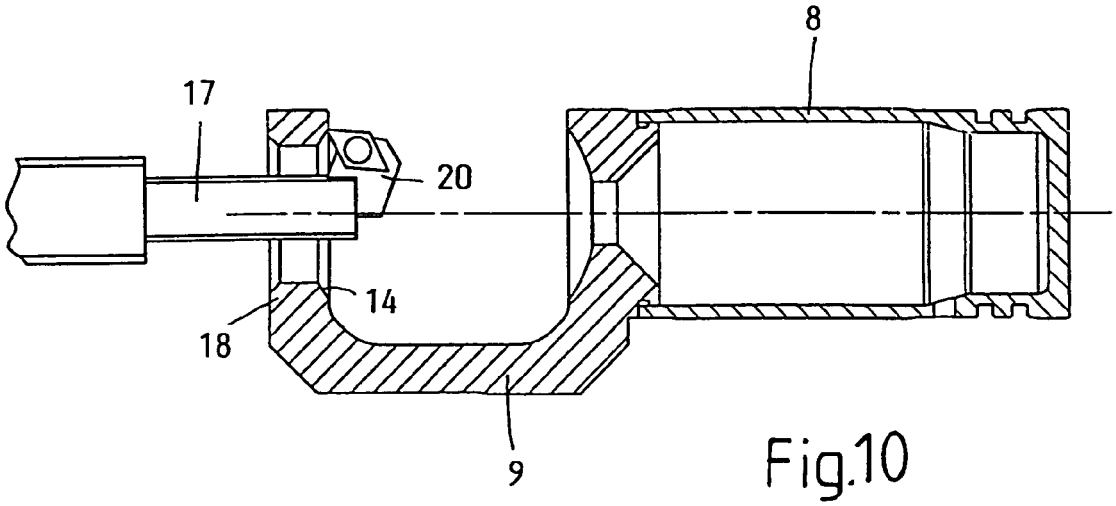
FIG. 10 A view corresponding to FIG. 9 on machining the e.g. facing action plane in FIG. 9.

In an advantageous development of the present invention, in accordance with FIGS. 9 and 10, the spherical surfaces 14, 15 can be produced by rotary driven, cutting tools 16, 17, in which at least one axially lateral boundary wall 18 of the coupling bracket 9 has an opening 21 allowing the insertion of the cutting head 19, 20 of tool 16, 17 into coupling bracket 9. Advantageously said opening 21 is located in the boundary wall 18 of coupling bracket 9 remote from the pistons 8, because the spherical surface 14 facing the opposite spherical surface 15 and surrounding said opening 21 is only loaded during the suction movement of the piston 8 and correspondingly by smaller forces than occur during the compression stroke.

The pistons 8 can be produced as separate parts in sleeve-like manner by deep drawing and are subsequently fixed to the coupling bracket 9. As opposed to this the coupling bracket 9 can be easily preshaped as a portion of an extruded profile.

The swivellable guidance of the wobble plate 11 necessary for controlling the piston stroke length and the coupling to the drive shaft 4 necessary for the rotary drive thereof takes place, according to the invention, through a four-bar linkage 22 formed by two articulated brackets 23, 24 swivellably mounted on the drive shaft 4, the spacing between the shaft-side joints 25, 26 and the spacing between the wobble plate-side joints 27, 28 of the four-bar linkage 22.

For a large adjustment range of the stroke length of pistons 8 in the case of a relatively small diameter of the wobble plate 11 and the resulting high delivery rate, the shaft-side joints 25, 26 are provided on the side of the shaft axis 30 opposite to the other joints 27, 28 on e.g. a right-angled recess 29 of the the drive shaft 4, so that the latter extends through an opening 33 provided eccentrically in the wobble plate 11. As a result of the described construction of the coupling of the wobble plate 11 to the pistons 8, said wobble plate can be made relatively thin over its entire radial extension, which further contributes to the construction of the compressor with a maximum delivery rate.

The spacing of the joints 27, 28 of the trapezoidal four-bar linkage 22 which is smaller than the spacing of the shaft-side joints 25, 26 is determined by the height of the cheek-like joint supports 31, 32 projecting bilaterally from the wobble plate 11.

Preferably the four-bar linkage 22 is provided bilaterally of the recess 29, i.e. is duplicated, said recess or bend 29 being laterally bounded by parallel surfaces 34, 35, so that they can also laterally guide the flattened articulated brackets 23, 24. The bilateral articulated brackets 23, 24 are preferably rigidly interconnected by a crossbar 36, which can also form a stop on the drive shaft 4 for a maximum swivelling movement of the articulated brackets 23, 24 and therefore the wobble plate 11.

If the four-bar linkage is provided in single instead of double form, the right-angled shaft bend and the joint supports 31, 32 provided on the wobble plate 11 can have a not shown, central guide slot for the bilateral guidance of a flat articulated bracket.

Figure 6:
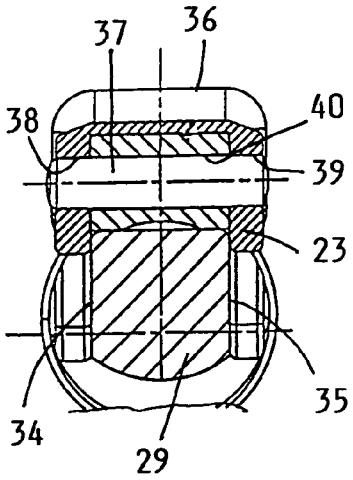
FIG. 6 A cross-sectional view of a joint along line VI-VI of FIG. 5.
Figure 7:
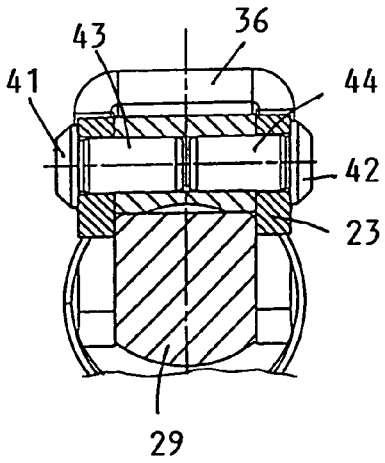
FIGS. 7 & 8 Cross-sectional views of other embodiments of the joint.
Figure 8:
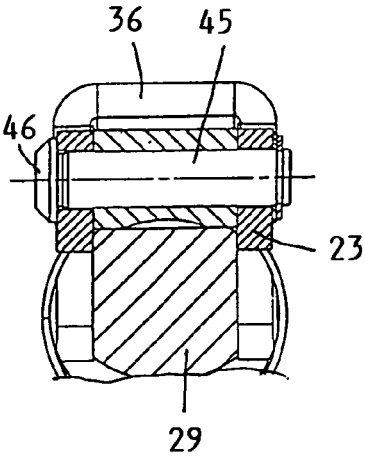

FIGS. 6 to 8 show three embodiments for the joints 25 to 28 of a double four-bar linkage 22.

According to FIG. 6, a hinge pin 37 is either secured by press fit in the bores 38, 39 provided in the articulated brackets 23, so that it has a plain bearing in the equiaxial bore 40 of the joint support 31 or the bores 38, 39 of the articulated brackets 23 form a plain bearing, so that the hinge pin 37 is held by press fit in the joint support 31.

According to FIG. 7, a hinge pin 43, 44 provided with a head 41, 42 is pressed in in nail-like manner on either side. In the embodiment according to FIG. 8 a through hinge pin 45 is used and is axially secured on the one hand by a pin head 46 and on the other by a retaining ring 47.

As the described joints 25 to 28 of the four-bar linkage 22 are consequently implemented as swivel joints, during the adjusting movement the frictional resistances are significantly reduced compared with the hitherto conventional slide joints, so that in this way the aforementioned set problem of an improved control behaviour is solved.

The invention claimed is:

1. Reciprocating piston compressor with several cylinder-piston units (7, 8) positioned parallel to one another and to a drive shaft (4) in a common compressor casing (3), the drive shaft (4) being embraced by a wobble plate (11) swivellably coupled thereto and to which the pistons (8) are connected by means of an articulated sliding coupling (12, 13), characterized in that the wobble plate (11) is coupled to the drive shaft (4) by means of a single or double four-bar linkage (22) comprising four uniaxially implemented joints and swivellable articulated brackets (23, 24) and in each case one (27, 28) of the uniaxially implemented four joints (25 to 28) are bilaterally provided on the wobble plate (11), whilst two other joints (25, 26) are provided in axially spaced manner on the drive shaft (4).

2. Compressor according to claim 1, characterized in that the joints (25, 26) provided with mutual axial spacing on the drive shaft (4) are provided on the side of the shaft axis (30) opposite to the wobble plate-side joints (27, 28) on a recess (29) of the drive shaft (4), so that the articulated brackets (23, 24) swivellable relative to the drive shaft (4) run transverse to the drive shaft axis (30) and the recess (29) extends through an eccentric opening (33) of the wobble plate (11).

3. Compressor according to claim 2, characterized in that cheek-like, laterally projecting joint supports (31, 32) are provided bilaterally on the wobble plate (11) and on each of the free ends thereof is located a joint (27, 28) of the single or double four-bar linkage (22).

4. Compressor according to claim 3, characterized in that the joints (25 to 28) of the four-bar linkage (22) are uniaxial swivel joints (FIGS. 6 to 8).

5. Compressor according to claim 1, characterized in that cheek-like, laterally projecting joint supports (31, 32) are provided bilaterally on the wobble plate (11) and on each of the free ends thereof is located a joint (27, 28) of the single or double four-bar linkage (22).

6. Compressor according to claim 5, characterized in that the joint supports (31, 32) and the recess (29) of the drive shaft (4) are laterally flattened and through each of these extends a hinge pin (37; 43, 44; 45) for the rotary mounting of flattened articulated brackets (23, 24) of a double four-bar linkage (22).

7. Compressor according to claim 1, characterized in that in each case one articulated bracket pair (23 or 24) of a double four-bar linkage (22) through a connecting bar (36) forms a rigid unit.

8. Compressor according to claim 1, characterized in that the articulated sliding coupling between the wobble plate (11) and the pistons (8) has spherical segmental sliding pads (12, 13) bilaterally engaging on the wobble plate (11) and which are held in spherical bearing surfaces (14, 15) worked into lateral boundary walls (18) of a coupling bracket (9) connected to the pistons (8).

9. Compressor according to claim 8, characterized in that at least one of the spherical bearing surfaces (14) surrounds an opening (21) in the adjacent, lateral boundary wall (18) of the coupling bracket (9).

10. Compressor according to claim 9, characterized in that the opening (21) is provided in the lateral boundary wall (18) remote from the piston (8) and through it can be introduced a tool (16, 17) for the rotary working of the bearing surface (14) in coupling bracket (9).

11. Compressor according to claim 8, characterized in that the pistons (8) comprise a deep-drawn sleeve and are fixed to a coupling bracket (9) comprising a portion of an extruded profile.

* * * * *